US005649583A

United States Patent [19]

Hsu

[11] Patent Number: 5,649,583

[45] Date of Patent: Jul. 22, 1997

[54] WATERFALL-LIKE WINDOW CURTAIN STRUCTURE

[75] Inventor: Peyson Hsu, Changhua Hsien, Taiwan

[73] Assignee: Ching Feng Blinds Ind. Co., Ltd., Changhua Hsien, Taiwan

[21] Appl. No.: 638,800

[22] Filed: Apr. 29, 1996

[51] Int. Cl.[6] ..... A47H 5/00

[52] U.S. Cl. ..... 160/84.05

[58] Field of Search ..... 160/84.01, 84.04, 160/84.05, 84.06, 264

[56] References Cited

U.S. PATENT DOCUMENTS

| | | | |
|---|---|---|---|
| 1,752,610 | 4/1930 | McSpadden | 160/84.04 |
| 3,777,800 | 12/1973 | Susoev | 160/84.04 |
| 4,069,857 | 1/1978 | Brookshire | 160/84.04 |
| 4,907,635 | 3/1990 | Bunger et al. | 160/84.04 |
| 4,921,032 | 5/1990 | May | 160/84.01 |
| 4,934,435 | 6/1990 | Regev | 160/84.04 |
| 5,273,096 | 12/1993 | Thomsen et al. | 160/84.01 |
| 5,355,928 | 10/1994 | Robertson | 160/84.04 |
| 5,425,408 | 6/1995 | Colson | 160/84.05 |
| 5,503,210 | 4/1996 | Colson et al. | 160/84.01 X |

*Primary Examiner*—David M. Purol
*Attorney, Agent, or Firm*—Browdy and Neimark

[57] ABSTRACT

The invention is directed to a waterfall-like window curtain structure including a rectangular base window curtain fabric and a layer of relatively transparent window curtain fabric added to outer side of the base fabric. The relatively transparent fabric is folded at vertical intervals to form multiple naturally suspending sections similar to a waterfall. The base fabric and the waterfall fabric are clamped together at intervals by at least one wooden strip. The at least one wooden strip is placed behind the base fabric and fastened from the outer side through the waterfall fabric so as to bind the base fabric, transparent fabric and the rearward wooden strip together. Each end of the wooden strips are formed with a pull cord through hole which allows an upper end of a pull cord to be passed upward from the lowermost wooden strip one by one through the through holes of the respective wooden strips and hung on and suspended from a pulley on an upper beam. By way of pulling the pull cord, the respective wooden strips are pulled upward and collected one by one.

6 Claims, 6 Drawing Sheets

WATERFALL-LIKE WINDOW CURTAIN STRUCTURE

BACKGROUND OF THE INVENTION

1. Technical Field of the Invention

The present invention relates to a waterfall-like window curtain structure including a rectangular base window curtain fabric and a layer of relatively transparent window curtain fabric added to the outer side thereof. The relatively transparent window curtain fabric is folded at vertical intervals to form multiple naturally suspending sections as a waterfall.

2. Prior Art

FIG. 1 shows a conventional window curtain structure which is pulled up longitudinally and includes a rectangular window curtain fabric 10 which is clamped at intervals by two wooden strips 11 with a nail nailed from the rear side through the wooden strips 11. Alternatively, a single wooden strip 11 is placed behind of the window curtain fabric 10 and the nail is nailed from an outer side through the window curtain fabric 10 so as to bind the window curtain fabric 10 and wooden strip 11 together. Each end of the wooden strip 11 is formed with a pull cord through hole 111, whereby on each side, an upper end of a pull cord 12 is passed upward from the lowermost wooden strip 11 one by one through the through holes 111 of the respective wooden strip 11 and hung on and suspended from a pull cord controller 14 of upper beam 13. By means of pulling the pull cord as shown by the phantom line of FIG. 1, the curtain fabric 10 between each pair of wooden strips 11 is folded one by one from the bottommost pair of strips 11. Alternatively, the pull cord can be moved downward to make the window curtain fabric drop down.

As shown in FIG. 2, in another type of conventional window curtain structure, the window curtain fabric 10' is folded at vertical equal intervals to form multiple U-shaped sections 13' for wrapping a wooden strip 131' fixed therein by stitching. Each end of the wooden strip 131' is stitched with a pull cord ring 14', whereby on each side, an upper end of a pull cord 12' is passed upward from the lowermost wooden strip one by one through the pull cord rings 14' of the respective wooden strips 131'. By means of pulling the pull cord 12', the respective wooden strips can be pulled upward and collected one by one. Alternatively, the pull cord 12' can be moved downward to make the window curtain fabric 10' drop down.

Each of the above conventional window curtain structures includes only a single sheet of curtain fabric which result in a poor and monotonous appearance without variation.

SUMMARY OF THE INVENTION

It is therefore a primary object of the present invention to provide a waterfall-like window curtain structure including a rectangular base window curtain fabric and has added more than one layer of relatively transparent window curtain fabric with different transparency and stripes to the outer side of the base window curtain fabric. The most transparent layer is located at the outermost position, while the second most transparent layer is located at the middle position and the least transparent layer is located at the innermost position. Moreover, the length of the suspending sections is gradually increased from inner side to outer side so as to form multi-layered waterfall-like suspending sections and create a perspectively visual and solid effect.

It is a further object of the present invention to provide the above waterfall-like window curtain structure in which the innermost base window curtain fabric is replaced by two rectangular fabrics which are binded with the equally spaced wooden strips at the position of the pull cords so as to save the material of the window curtain.

The present invention can be best understood through the following description and accompanying drawings, wherein:

DETAILED DESCRIPTION OF THE PREFERRED EMBODIMENTS

Figure 1:
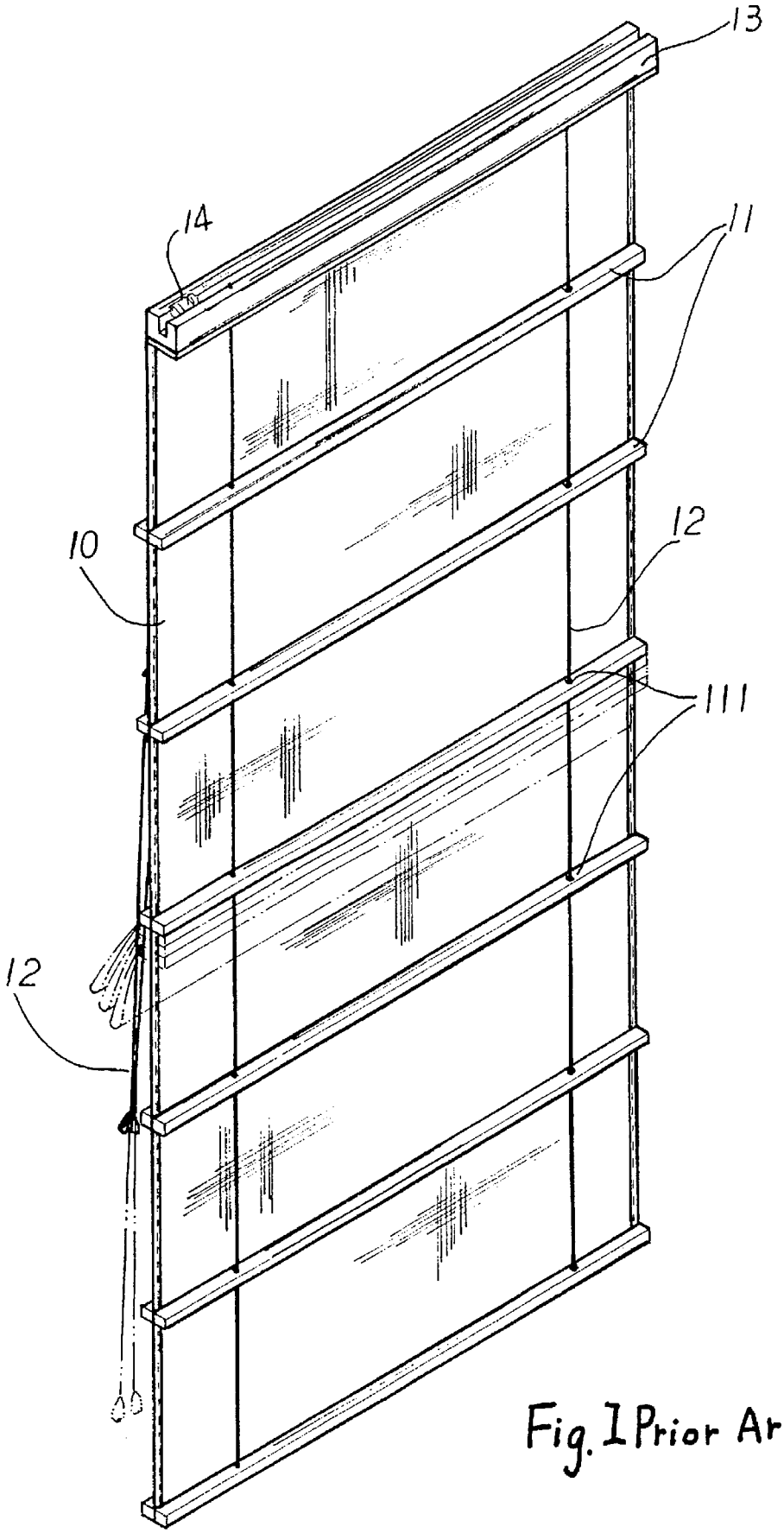
Fig. 1 Prior Art
FIG. 1 is a perspective view of a conventional longitudinally pulled type of window curtain structure.
Figure 2:
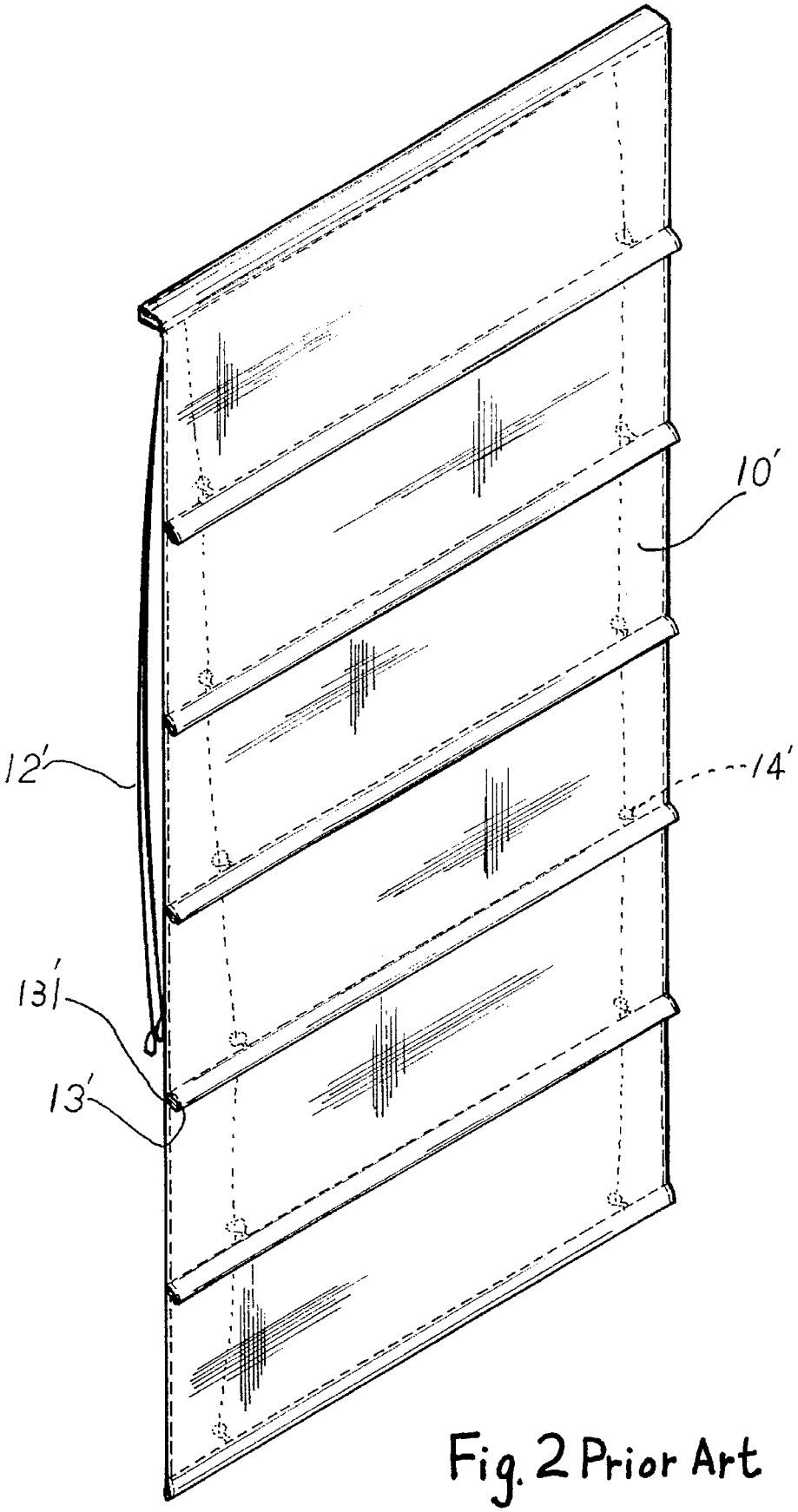
Fig. 2 Prior Art
FIG. 2 is a perspective view of another conventional longitudinally pulled type of window curtain structure.
Figure 3:
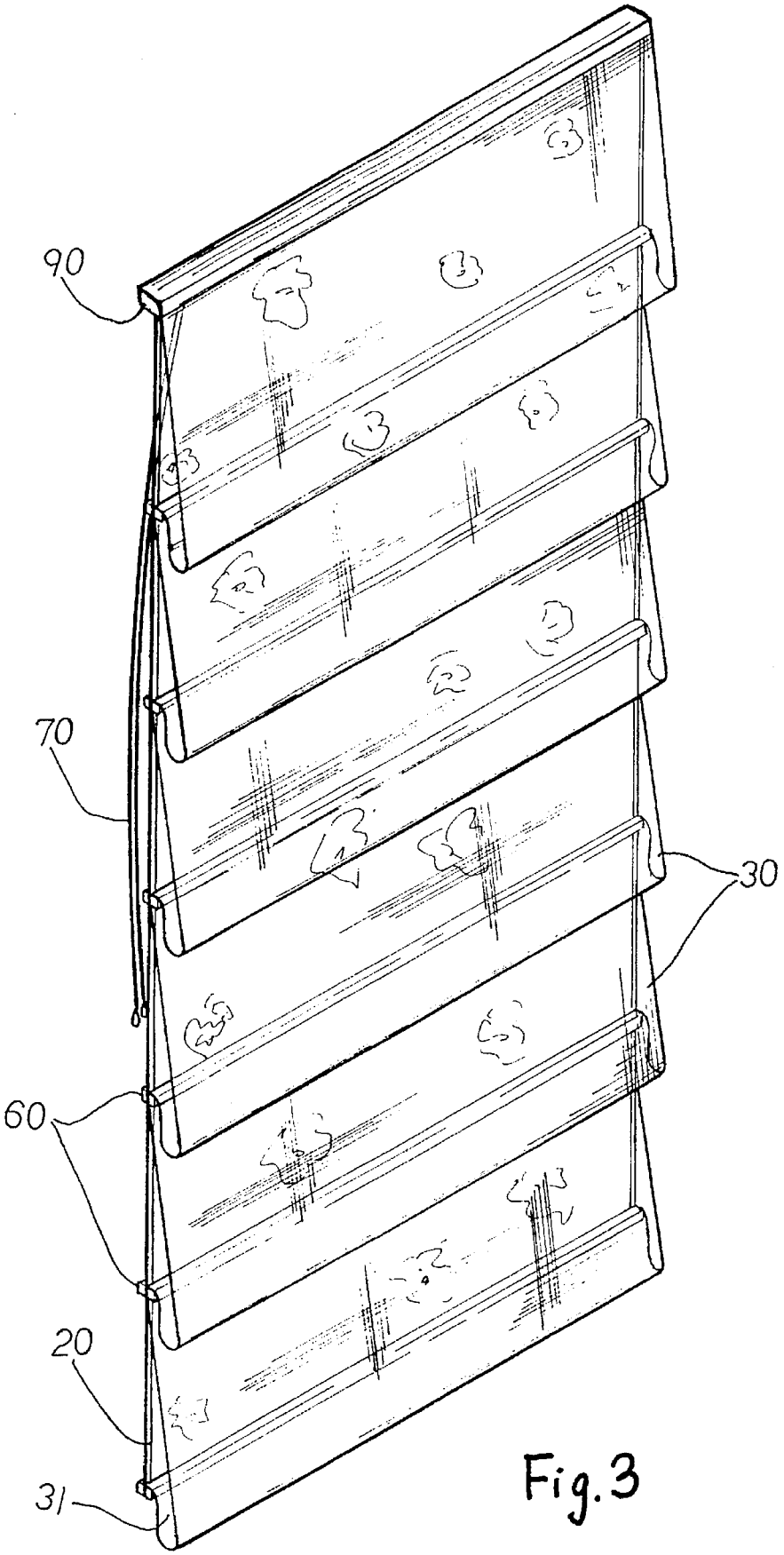
FIG. 3 is a perspective view of the present invention with one layer of transparent window curtain fabric.
Figure 5:
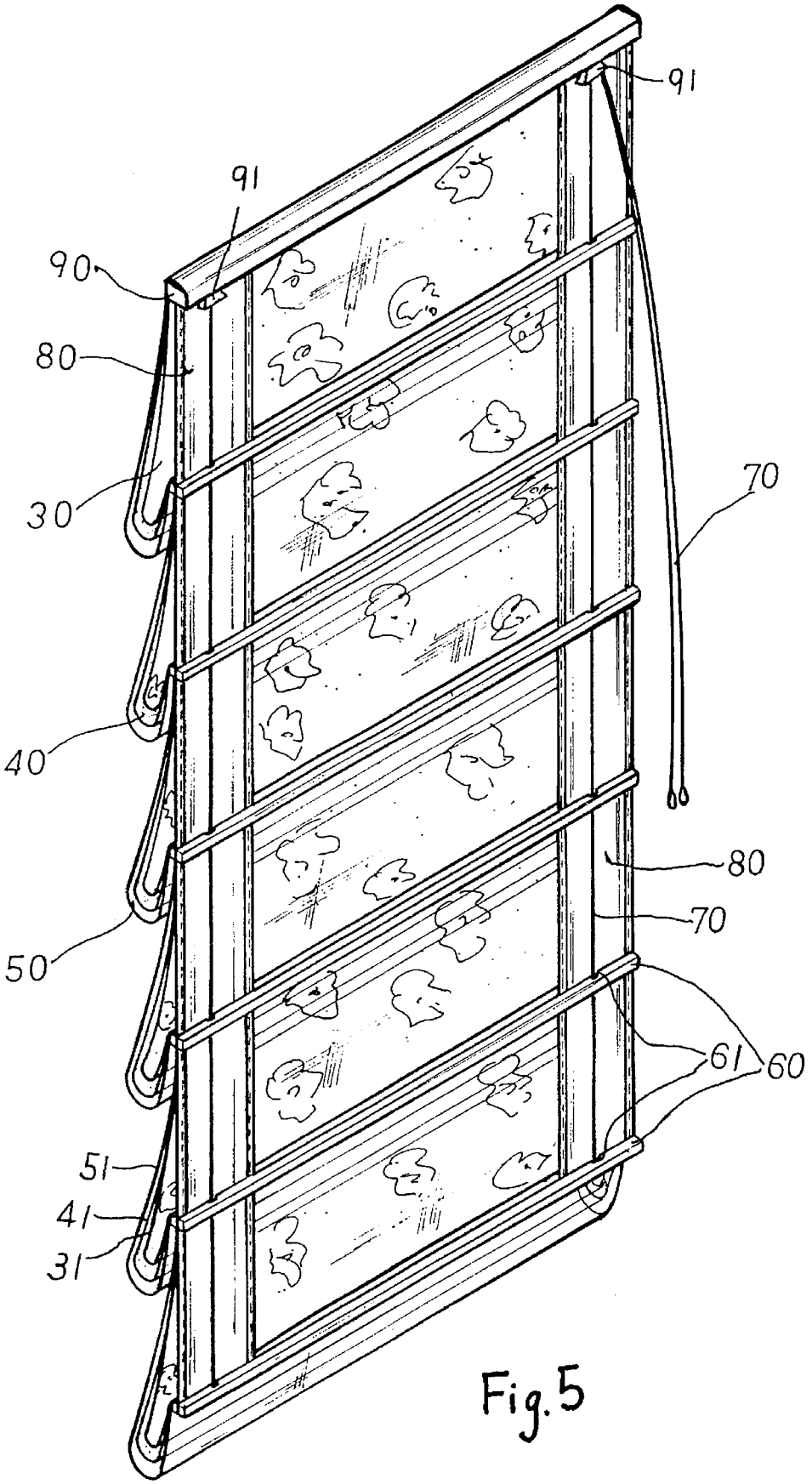
FIG. 5 is a perspective view of the present invention with multiple layers of transparent window curtain fabrics.

Please refer to FIG. 3. The present invention includes a rectangular base window curtain fabric 20 and a layer of relatively transparent window curtain fabric 30 added to outer side thereof. The relatively transparent window curtain fabric 30 is folded at vertical intervals to form multiple naturally suspending sections 31 as a waterfall. The base window curtain fabric 20 and the waterfall window curtain fabric 30 are clamped at intervals by two wooden strips or imitative wooden strips 60 and a nail is nailed from the rear side through the wooden strips 60. Alternatively, a single wooden strip or imitative wooden strip 60 is placed behind of the base window curtain fabric 20 and the nail is nailed from outer side through the waterfall window curtain fabric 30 so as to bind the base window curtain fabric 20, transparent window curtain fabric 30 and the rearward wooden strip 60. Referring to FIG. 5, each end of the wooden strip 60 is formed with a pull cord through hole 61, whereby on each side, an upper end of a pull cord 70 is passed upward from the lowermost wooden strip 60 one by one through the through holes 61 of the respective wooden strip 60 and hung on and suspended from a pulley 91 of upper beam 90. The pull cord 70 and the pulley 91 are both located behind the base window curtain fabric 20 so that by means of pulling the pull cord 70, the respective wooden strips 60 can be pulled upward and collected one by one. Alternatively, the pull cord 70 can be moved down to lower the base window curtain fabric 20 and the transparent window curtain fabric 30 to form a double-layered waterfall-like pattern with an improved visual effect.

Figure 4:
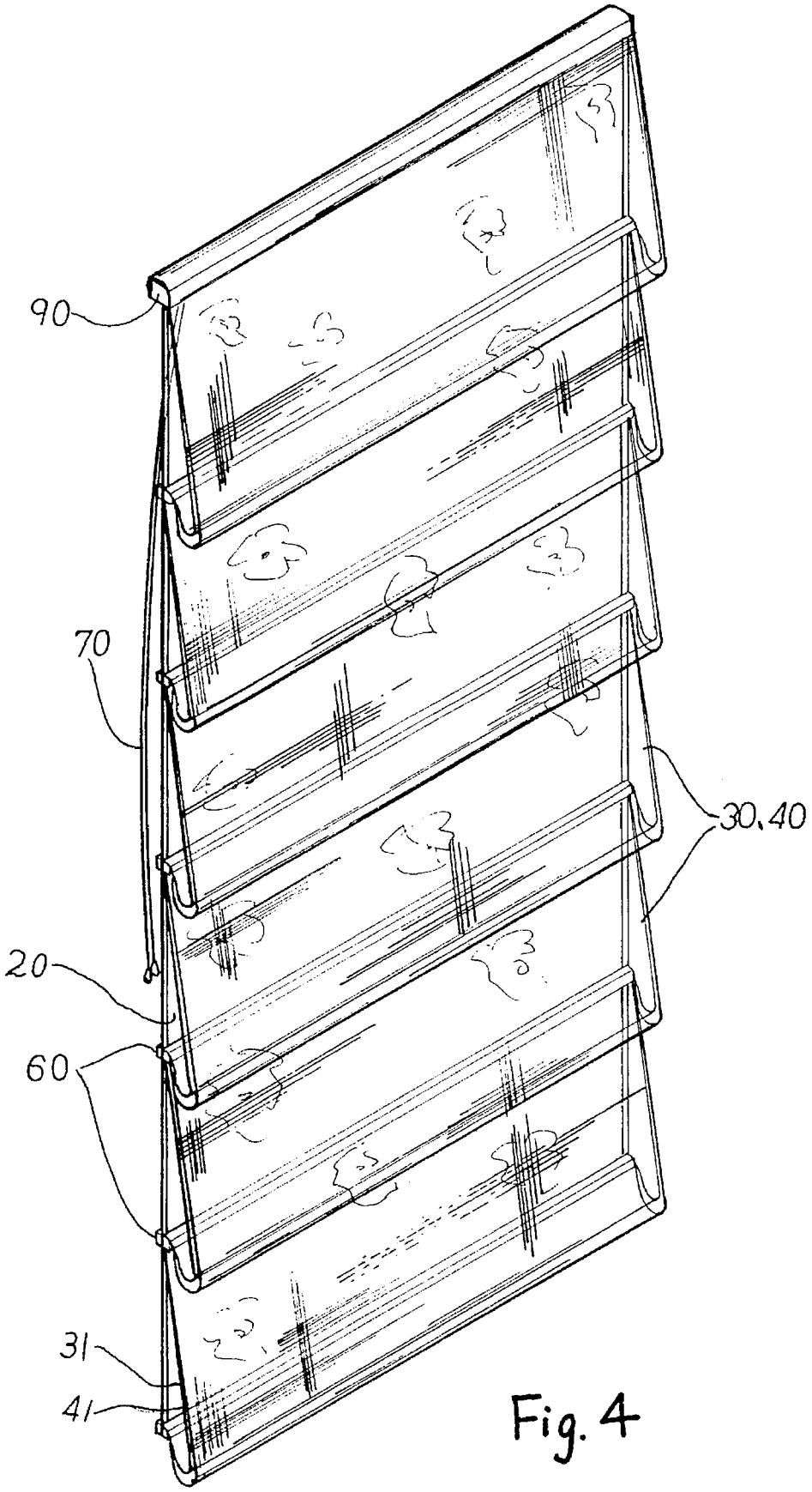
FIG. 4 is a perspective view of the present invention with two layers of transparent window curtain fabrics.

In addition, as shown in FIGS. 4 and 5, more than one layer of window curtain fabrics 30, 40, 50 with different transparency and stripes can be disposed in front of the base window curtain fabric 20. The most transparent layer is located at the outermost position, while the second most transparent layer is located at the middle position and the least transparent layer is located at the innermost position. Moreover, the length of the suspending sections is gradually increased from inner side to outer side so as to form multi-layered waterfall-like suspending sections 31, 41, 51 and create a perspectively visual and solid effect.

Referring to FIG. 5, the innermost base window curtain fabric can be replaced by two rectangular fabrics 80 which are binded with the equally spaced wooden strips 60 at the position of the pull cords 70 so as to save the material of the window curtain.

Figure 6:
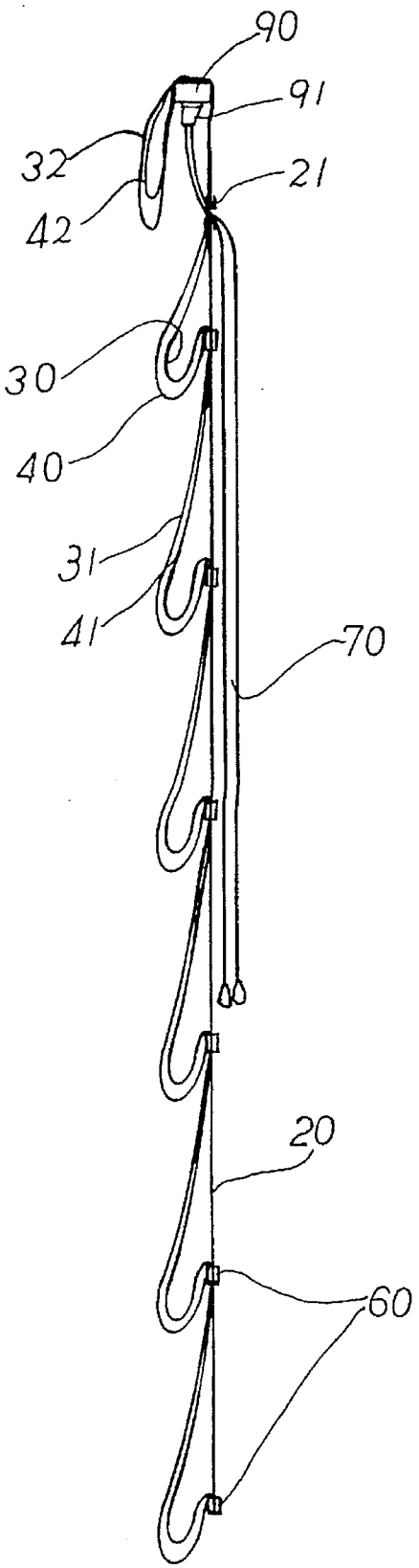
FIG. 6 is a side view of the present invention, showing a modified embodiment thereof.

Referring to FIG. 6, a rivet 21 can be engaged to an upper portion of the waterfall window curtain near one end thereof, whereby the pull cord 70 hung on the pulley 91 under the upper beam 90 can pass through a hole in the rivet 21 from the upper front side of the waterfall window curtain to suspend behind the base window curtain fabric 20. In addition, the transparent window curtain fabrics 30, 40 above the upper beam 90 are reversely folded into a suspending section 32, 42 so as to shade the pulley 91 and the pull cord 70 under the upper beam 90.

The above embodiment are only some examples of the present invention and the scope of the present invention should not be limited to the examples. Any modification or variation derived from the examples should fall within the scope of the present invention.

What is claimed is:

1. A waterfall-like window curtain structure comprising a rectangular base window curtain fabric and a layer of relatively transparent window curtain fabric engaged to an outer side of the base window curtain fabric, the relatively transparent window curtain fabric being engaged to the base window curtain fabric at vertical intervals to form a plurality of suspending sections in front of said base window curtain fabric, the base window curtain fabric and the transparent window curtain fabric being engaged together at each vertical interval of said vertical intervals by at least one wooden strip, said at least one wooden strip being placed behind the base window curtain fabric and fastened from an outer side through the transparent window curtain fabric so as to engage the base window curtain fabric, the transparent window curtain fabric and the at least one wooden strip together, each end of each said wooden strip being formed with a through hole, whereby an upper end of a pull cord is passed upward from the lowermost wooden strip one by one through the through holes at said each end of each said wooden strip and hung on and suspended from a pulley on an upper beam, wherein when the pull cord is pulled each said wooden strip is pulled upward and collected one by one, wherein alternatively when the pull cord is moved downward the base window curtain fabric and the transparent window curtain fabric are lowered to form a double-layered waterfall-like pattern.

2. A waterfall-like window curtain structure as claimed in claim 1, wherein more than one layer of window curtain fabric with different transparency and stripes can be disposed in front of the base window curtain fabric, the most transparent layer being located at the outermost position, while the second most transparent layer is located at the middle position and the least transparent layer is located at the innermost position, the length of each suspending section of said suspending sections being gradually increased from the inner side to the outer side so as to form multi-layer waterfall-like suspending sections and create a perspectively visual and solid effect.

3. A waterfall-like window curtain structure as claimed in claim 1, wherein the base window curtain fabric comprises two rectangular fabrics spaced apart and engaged to the wooden strips adjacent the pull cords so as to save base window curtain fabric.

4. A waterfall-like window curtain as claimed in claim 1, wherein the pull cord and the pulley are both located behind the base window curtain fabric.

5. A waterfall-like window curtain structure as claimed in claim 1, wherein a rivet having a hole therethrough is fastened on an upper portion of the waterfall window curtain near one end thereof, whereby the pull cord is hung on a pulley under the upper beam and can pass through the hole in the rivet from an upper front side of the waterfall window curtain to suspend behind the base window curtain fabric, the transparent window curtain fabric above the upper beam being reversely folded into a suspending section so as to conceal the pulley and the pull cord under the upper beam.

6. A waterfall-like window curtain structure as claimed in claim 1, wherein two wooden strips engage the base window curtain fabric and the transparent window curtain fabric at each said vertical interval, a first of said wooden strips being placed behind the base window curtain fabric and a second of said two wooden strips being placed in front of said transparent window curtain fabric with each fabric being engaged between the two wooden strips.

* * * * *